US007757534B2

(12) United States Patent
Shiga et al.

(10) Patent No.: US 7,757,534 B2
(45) Date of Patent: Jul. 20, 2010

(54) PRESS DIE, BURRING MACHINING METHOD, METHOD OF MANUFACTURING PRESSED PRODUCT, AND PRESSED PRODUCT

(75) Inventors: Hideaki Shiga, Odawara (JP); Masayoshi Moriwaki, Odawara (JP)

(73) Assignee: FUJIFILM Corporation, Tokyo (JP)

( * ) Notice: Subject to any disclaimer, the term of this patent is extended or adjusted under 35 U.S.C. 154(b) by 532 days.

(21) Appl. No.: 11/783,504

(22) Filed: Apr. 10, 2007

(65) Prior Publication Data

US 2007/0234776 A1 Oct. 11, 2007

(30) Foreign Application Priority Data

Apr. 11, 2006 (JP) ..... 2006-108799

(51) Int. Cl.
*B21D 28/00* (2006.01)
*B21D 31/02* (2006.01)

(52) U.S. Cl. ..... 72/332; 72/325

(58) Field of Classification Search ..... 72/325, 72/326, 327, 332, 333, 334, 335
See application file for complete search history.

(56) References Cited

U.S. PATENT DOCUMENTS 2,157,354 A * 5/1939 Sherman ..... 72/349
5,458,717 A * 10/1995 Kurita ..... 156/253
5,584,202 A * 12/1996 Kanamaru et al. ..... 72/105
6,389,869 B1 * 5/2002 Wakita et al. ..... 72/379.2

FOREIGN PATENT DOCUMENTS

JP 2002-11526 A 1/2002

* cited by examiner

*Primary Examiner*—Dana Ross
*Assistant Examiner*—Mohammad Yusuf
(74) *Attorney, Agent, or Firm*—Sughrue Mion, PLLC

(57) ABSTRACT

A burring method forms a boss on a metal sheet, using a press die including: a die with a burring hole formed therein; and a burring punch having a shape adapted to be inserted into the burring hole. In the burring method, a width of a clearance formed between the burring hole and the burring punch is in a range not less than 60% and not more than 115%, preferably not less than 65% and not more than 100%, and more preferably, not less than 75% and not more than 95%, of a thickness of the metal sheet, before the metal sheet goes through a burring process.

30 Claims, 5 Drawing Sheets

PRESS DIE, BURRING MACHINING METHOD, METHOD OF MANUFACTURING PRESSED PRODUCT, AND PRESSED PRODUCT

CROSS REFERENCE TO RELATED APPLICATIONS

This application claims the benefit of Japanese Patent Application No. 2006-108799 filed on Apr. 11, 2006, the disclosure of which is incorporated herein by reference.

BACKGROUND OF THE INVENTION

1. Field of the Invention

The present invention relates to a press die, a burring method using the press die, a method of manufacturing a pressed product, and the pressed product.

2. Description of the Related Art

Burring is a press working technique to punch a pilot hole on a workpiece such as a metal sheet, and to form a flange (a boss) along an edge of the pilot hole.

The burring uses a die and a burring punch. The die has a burring hole formed therein, which has a diameter larger than the pilot hole of the workpiece, and substantially the same as an outer diameter of a desired boss. The burring punch in a rod shape has a diameter substantially the same as an inner diameter of the desired boss. The workpiece is then placed on a stage of the die, such that a center of the burring hole of the die and that of the pilot hole of the workpiece are substantially aligned. After that, the burring punch is inserted into the burring hole from a surface of the workpiece on an opposite side of the die. This allows the edge of the pilot hole to be pressed and extended owing to a pressing force of the burring punch, and to be thereby bent along an edge of the burring hole of the die. As a result, a boss is formed on the workpiece (see, for example, Japanese Laid-Open Patent Application, Publication No. 2002-11526).

The burring described above needs to be performed such that a height of the boss and a thickness of the workpiece are uniform in any part, without cracks or fractures which would otherwise be generated upon the burring.

A press die 101 according to a conventional burring method as shown in FIG. 5 needs to form a product having a uniform height of a boss 111 and a uniform thickness of the product. Therefore, according to a rule of thumb, a radial-direction width of a clearance S between a burring hole 103 and a burring punch 104 upon the burring is usually set at about ½ of a thickness of a workpiece 110.

The conventional burring method can obtain the uniform height of the boss 111 and the uniform thickness of the product. However, the conventional burring method has a problem that a large warpage is generated on a planar part 112 surrounding the boss 111. In particular, when the conventional burring method is applied to a relatively thin workpiece 110 (for example, 0.5 mm or less), a notably large warpage is generated on the planar part 112.

The present invention has been made to solve the problem. The present invention proposes: a press die capable of reducing a warpage to be generated on a planar part surrounding a boss, which is formed with burring; a burring method using the press die; a method of manufacturing a pressed product; and the pressed product.

SUMMARY OF THE INVENTION

According to a first aspect of the present invention, a press die for forming a boss on a workpiece is provided. The press die includes: a die with a burring hole formed therein; and a burring punch having a shape adapted to be inserted into the burring hole. The press die has a clearance which is formed between the burring hole and the burring punch when the burring punch is inserted into the burring hole. Herein, a radial-direction width of the clearance is in a range not less than 60% and not more than 115% of a thickness of the workpiece before the workpiece goes through a burring process.

In the press die, the width of the clearance between the burring hole and the burring punch is in the range not less than 60% and not more than 115% of the thickness of the workpiece, when the burring punch burring-machines a surrounding edge of a pilot hole formed on the workpiece. Thus a boss is formed in a state where the workpiece is compressed. This allows the boss to be bent well from its base portion along the burring hole, to thereby form the boss in a desired shape. Further, plastic deformation is caused at the base portion of the boss, so that a warpage on a planar part surrounding the boss is significantly reduced. It is to be noted that the warpage on the planar part can be reduced more effectively, if the width of the clearance between the burring hole and the burring punch is in a range between 65% and 100% of the thickness of the workpiece. If the width of the clearance is in a range between 75% and 95%, the warpage can be reduced further effectively.

According to a second aspect of the present invention, a burring method for forming a boss on a workpiece is provided. The burring method includes the steps of: fixing the workpiece on a die with a burring hole formed therein; and pressing into the burring hole, a burring punch having a shape adapted to be inserted into the burring hole, from a direction opposite to a contact surface on which the workpiece is in contact with the die. In the burring method, a clearance is formed between the burring hole and the burring punch, when the burring punch is inserted into the burring hole. Herein, a width of the clearance is in a range not less than 60% and not more than 115% of the thickness of the workpiece, before the workpiece goes through the burring process.

In the burring method, a pressed product with a boss formed thereon has less warpage on a planar part surrounding the boss, and is formed with an excellent flatness of the planar part, as compared to a pressed product manufactured in a conventional burring method. A warpage on the planar part can be reduced more effectively, if the width of the clearance between the burring hole and the burring punch is in the range between 65% and 100% of the thickness of the workpiece. If the width of the clearance is in the range between 75% and 95%, the warpage can be reduced further effectively.

According to a third aspect of the present invention, a method of manufacturing a pressed product is provided. The method of manufacturing a pressed product manufactures a pressed product having a planar part and at least one boss formed on the planar part, obtained by burring a workpiece using a press die including: a die with a burring hole formed therein; and a burring punch having a shape adapted to be inserted into the burring hole. In the method of manufacturing a pressed product, a clearance is formed between the burring hole and the burring punch when the burring punch is inserted into the burring hole. Herein, the width of the clearance is in a range not less than 60% and not more than 115% of the thickness of the workpiece, before the workpiece goes through the burring process.

In the method of manufacturing a pressed product, the pressed product having a planar part with an excellent flatness and a boss can be manufactured. Further, a warpage on the planar part can be reduced more effectively, if the width of the clearance between the burring hole and the burring punch is in a range between 65% and 100% of the thickness of the workpiece. If the width of the clearance is in a range between 75% and 95%, the warpage can be reduced further effectively.

According to a fourth aspect of the present invention, a pressed product is provided. The pressed product has a planar part and at least one boss formed on the planar part. The pressed product is obtained by burring a workpiece using a press die including: a die with a burring hole formed therein; and a burring punch having a shape adapted to be inserted into the burring hole. In the pressed product, a thickness of a boss made of the workpiece is in a range not less than 70% and not more than 115% of a thickness of the workpiece, before the workpiece goes through the burring process.

According to a fifth aspect of the present invention, the pressed product according to the fourth aspect of the present invention is provided. The pressed product has the workpiece having a thickness of 0.5 mm or less, before the workpiece goes through the burring process.

According to a sixth aspect of the present invention, the pressed product according to the fourth or fifth aspect of the present invention is provided. The pressed product has the boss formed at an angle in a range not less than 85 degrees and not more than 95 degrees with respect to the planar part.

According to a seventh aspect of the present invention, the pressed product according to the fourth or fifth aspect of the present invention is provided. The pressed product has the planar part having a flatness of not more than 9% with respect to a distance between the boss and an outer circumference of the planar part.

Other features and advantages of the present invention will become more apparent from the following detailed description of the invention, when taken in conjunction with the accompanying exemplary drawings.

DETAILED DESCRIPTION OF THE EXEMPLARY EMBODIMENT

Next is described an exemplary embodiment of the present invention with reference to the related drawings. The embodiment assumes that what is manufactured as a pressed product herein is a component of a cartridge for accommodating a magnetic medium, more specifically, a shutter member of the cartridge.

Figure 1A:
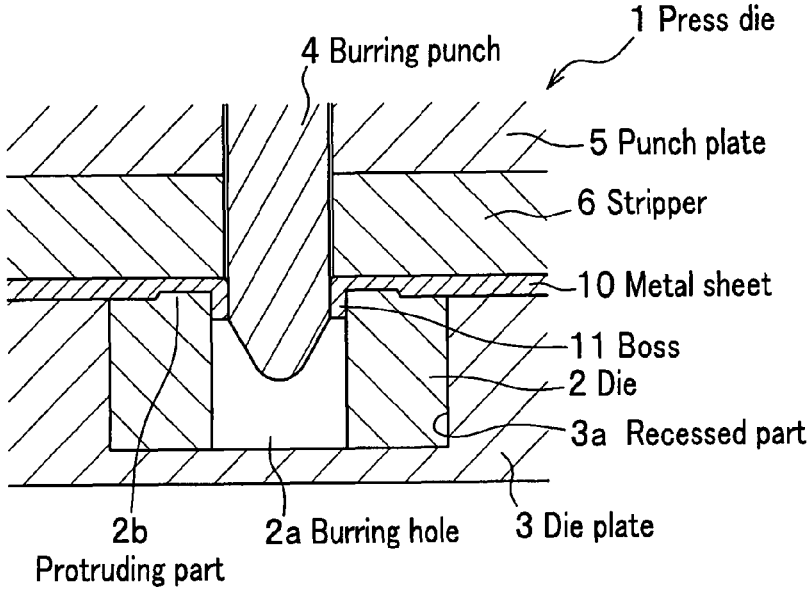
FIG. 1A is a cross sectional view showing a press die according to an embodiment of the present invention.
Figure 1B:
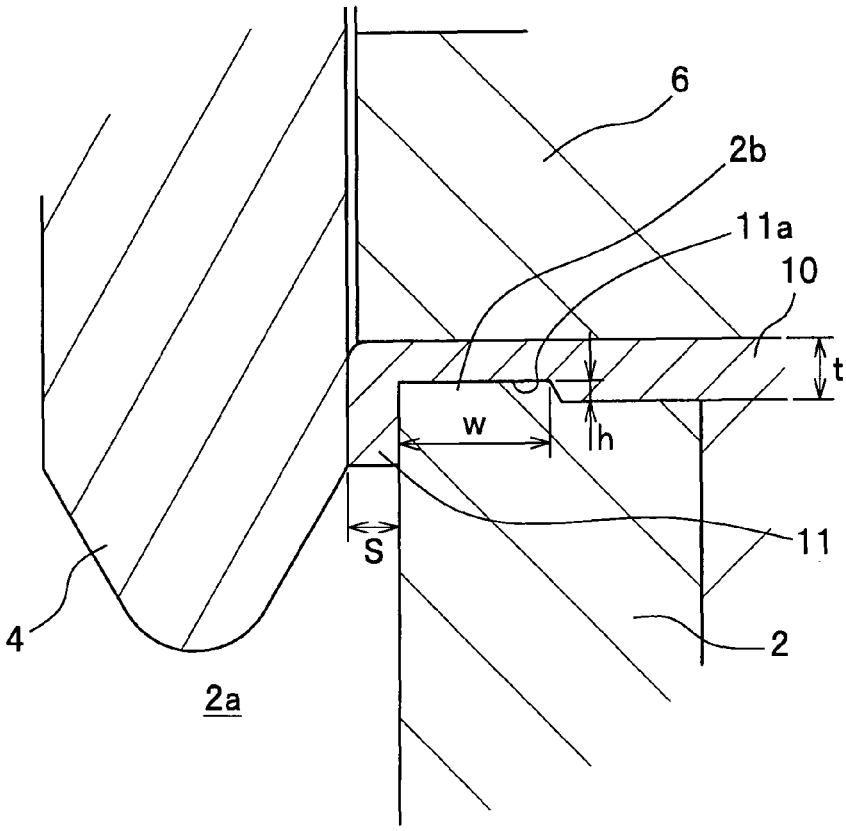
FIG. 1B is a partially enlarged view showing a portion of FIG. 1A.

As shown in FIG. 1A, a press die 1 according to the embodiment includes: a die 2 having a burring hole 2*a* formed therein; a stripper 6 placed opposite to the die 2 across a metal sheet 10 as a workpiece; and a burring punch 4 formed in a shape adapted to be inserted into the burring hole 2*a*.

Figure 2A:
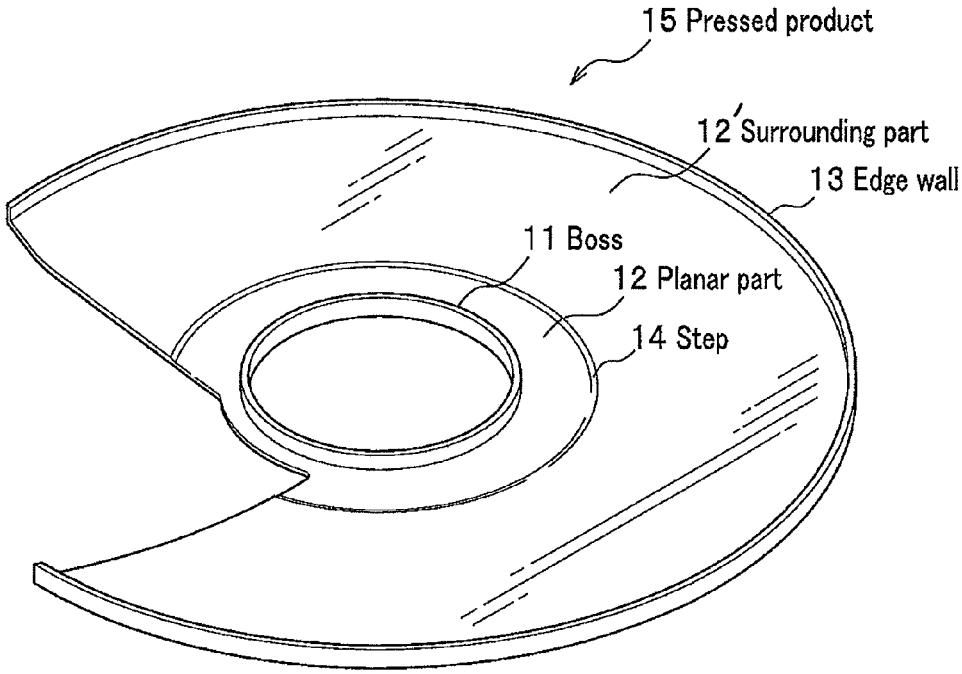
FIG. 2A is a perspective view of a pressed product according to the embodiment.
Figure 2B:
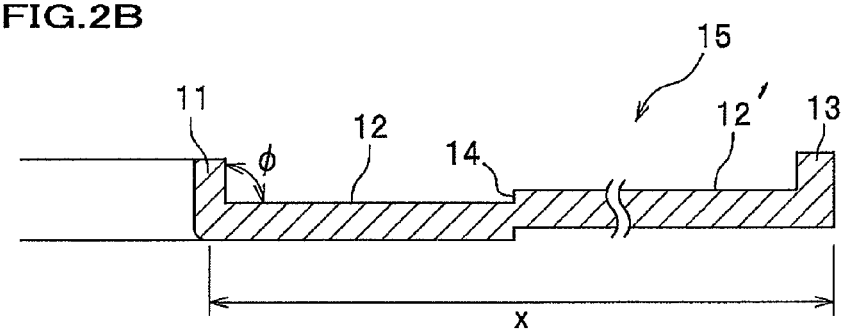
FIG. 2B is a cross sectional view showing the pressed product of FIG. 2A.

The metal sheet 10 used in the embodiment has a thickness t of not more than 0.5 mm, and preferably, not more than 0.3 mm, and more preferably, not more than 0.25 mm. As shown in FIG. 2A, the embodiment assumes that the metal sheet 10 is burring machined, and is formed into a pressed product 15 having a boss 11 formed at its center. A planar part 12 surrounding the boss 11 has such a high quality that a warpage is not generated (or is reduced) thereon even after the burring. In FIG. 2A, reference numeral 13 indicates an edge wall formed on a circumferential edge of the pressed product 15, which is formed by a drawing technique. Reference numeral 14 indicates a step formed by a step-forming technique.

As shown in FIG. 1A, the die 2 is placed into a recessed part 3*a* formed in a die plate 3. The press die 1 according to the embodiment has a configuration in which the die 2 can be replaced by another. According to a desired shape of the boss 11, the die 2 with a suitable burring hole 2*a* formed therein can be placed.

The die 2 is constituted of a cylindrical steel member having the burring hole 2*a* at its center. The burring hole 2*a* is formed according to the shape of the boss 11 (see FIG. 2A) of the pressed product 15. A protruding part 2*b* (see FIG. 1A) protruding toward the stripper 6 is formed on an inner circumferential edge of an upper surface of the die 2, surrounding the burring hole 2*a*. A material constituting the die 2 is not limited to the cylindrical steel member but may be selected among any known materials which are strong enough not to be deformed even when the metal sheet 10 is pressed and machined.

The burring hole 2*a* is formed substantially at the center of the die 2. In the embodiment, the burring hole 2*a* has a cross section in a circular shape according to a desired shape of the boss 11. A diameter of the burring hole 2*a* is made larger than a cylindrical-part diameter of the burring punch 4 to be described later. When the burring punch 4 is inserted into the burring hole 2*a*, a clearance S having a predetermined radial-direction width is formed. In the embodiment, the width of the clearance S between the burring hole 2*a* and the burring punch 4 is configured to be in a range not less than 60% and not more than 115% of the thickness t of the metal sheet 10. The width of the clearance S between the burring hole 2*a* and the burring punch 4 is not limited, as long as it is in the range not less than 60% and not more than 115% of the thickness t. However, it is preferably in a range not less than 65% and not more than 100%, and more preferably, in a range not less than 75% and not more than 95%.

In the embodiment, the burring hole 2*a* is assumed to have the cross section in a circular shape. However, the cross section of the burring hole 2*a* may be formed, for example, in a square, rectangular, oval, or any other shape according to a desired shape of the boss 11.

A shape of the protruding part 2*b* is not limited, as long as the protruding part 2*b* can firmly hold the metal sheet 10 so that the metal sheet 10 will not move during the burring. In the embodiment, the protruding part 2*b* is formed to have a width w in a range between 50% and 400%, and preferably, between 150% and 300% of the thickness t of the metal sheet 10; and to have a height h in a range between 5% and 20% of the thickness t of the metal sheet 10.

As shown in FIG. 1A, the burring punch 4 is fixed to the punch plate 5. As the punch plate 5 comes down, a tip of the burring punch 4 is inserted into the burring hole 2*a* in the die 2.

The burring punch 4 is a steel member in a rod shape. However, the tip (a lower end) of the burring punch 4 is tapered off, so that the nearer to the tip, the smaller the diameter of the burring punch 4. The burring punch 4 is configured such that the cylindrical-part diameter is substantially the same as an inner diameter of the boss 11 (see FIG. 2A). The burring punch 4 is also configured such that the width of the clearance S, which is formed between itself and the burring hole 2*a*, is in the range described above. It is to be noted that a shape of the burring punch 4 is not limited, and any known shape may be used according to the necessity.

In the embodiment, the metal sheet 10 goes through the burring process, when the burring punch 4 comes from above down to the metal sheet 10. However, the metal sheet 10 may go through the burring process, when the burring punch 4 comes from below up to the metal sheet 10. The burring punch 4 may operate in any other direction.

The stripper 6 in a plate shape comes in contact with the metal sheet 10 from a direction opposite to a contact surface of the metal sheet 10 on which the metal sheet 10 is in contact with the die 2. Thus the stripper 6, together with the die 2, firmly holds the metal sheet 10. A gap is present between the stripper 6 and the punch plate 5. A spring member not shown is provided in the gap.

A configuration of the stripper 6 is not limited, as long as the stripper 6 together with the die 2 can firmly fix the metal sheet 10 by holding the metal sheet 10.

Figure 3A:
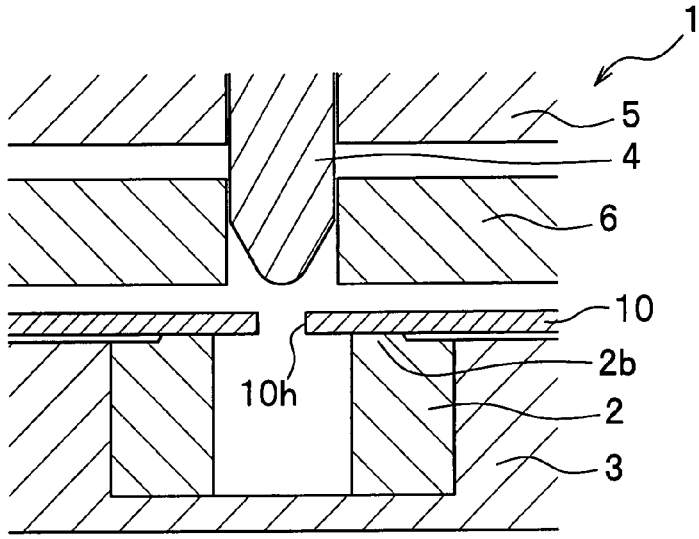
FIG. 3A, FIG. 3B and FIG. 3C are cross sectional views showing sequential steps of a burring method according to the embodiment.
Figure 3B:
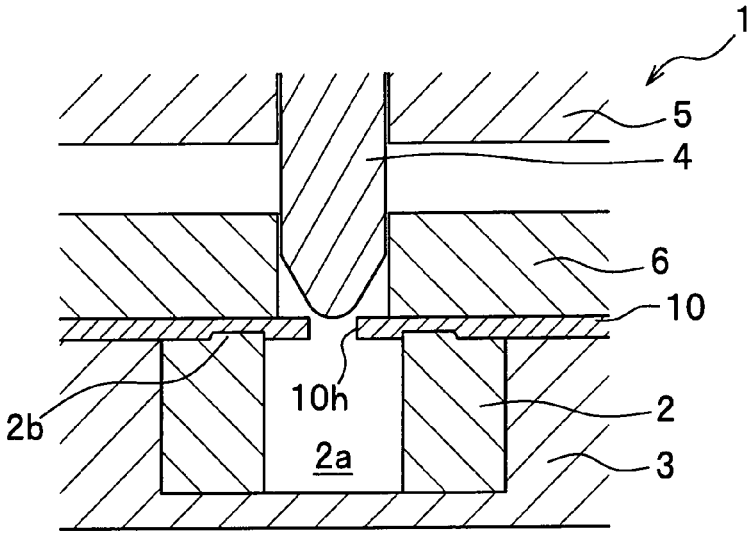
Figure 3C:
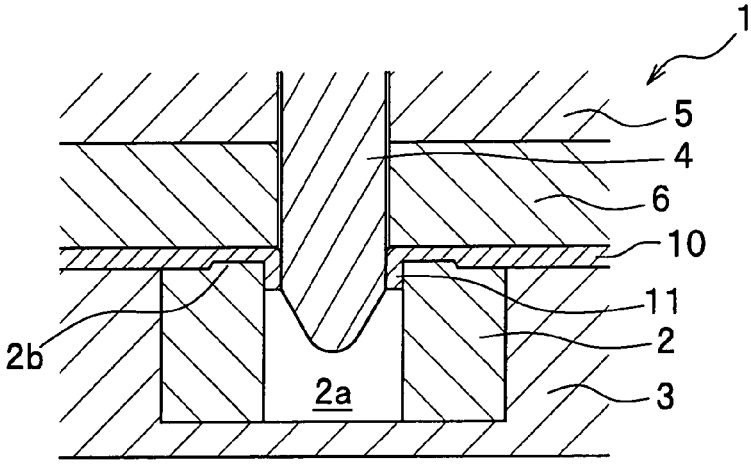

Referring to FIG. 3A, FIG. 3B and FIG. 3C, the burring method according to the embodiment is described next.

The embodiment assumes that the boss 11 is formed in a circular shape as shown in FIG. 2A. However, the shape of the boss 11 is not limited to a circle, and may be any other shape according to a purpose of using the pressed product 15.

The burring method according to the embodiment is a method of manufacturing a pressed product having a planar part 12 and the boss 11 formed on the planar part 12 as shown in FIG. 1A, 1B, 2A and 2B. In the burring method, the pressed product 15 is manufactured by burring the metal sheet 10 using the press die 1 including: the die 2 having the burring hole 2*a* formed therein; and the burring punch 4 formed in a shape adapted to be inserted into the burring hole 2*a*. The press die 1 used herein has a configuration in which the width of the clearance S, which is formed between the burring hole 2*a* and the burring punch 4 when the burring punch 4 is inserted into the burring hole 2*a*, is in the range between 60% and 115%, preferably between 65% and 100%, and more preferably between 75% and 95% of the thickness of the metal sheet 10, before the metal sheet 10 goes through the burring process.

The burring method includes: a placing step of placing the metal sheet 10 on the die 2; a fixing step of fixing the metal sheet 10 by bringing the stripper 6 in contact with an upper surface of the metal sheet 10, which has been provided on the upper surface of the die 2; and a burring step of forming the boss 11 by pressing the burring punch 4 into the fixed metal sheet 10.

<Placing Step>

As shown in FIG. 3A, the placing step is for placing the metal sheet 10 having a pilot hole 10*h* formed in advance, on the upper surface of the die 2 having the burring hole 2*a*. In this step, the metal sheet 10 is placed such that a center of the burring hole 2*a* and that of the pilot hole 10*h* are substantially aligned. The alignment makes a height of the boss 11 uniform, when the boss 11 is formed afterwards in the burring step.

In the placing step, the stripper 6 is in a raised position. A gap is present between the stripper 6 and the die 2, so that the metal sheet 10 is allowed to move. On the other hand, a gap between the stripper 6 and the punch plate 5 is narrow, because the stripper 6 is raised up.

<Fixing Step>

As shown in FIG. 3B, the fixing step is for fixing the metal sheet 10 by pressing the stripper 6 against an upper surface (a surface opposite to the die 2) of the metal sheet 10, which has been placed on the upper surface of the die 2 in the placing step, to thereby hold the metal sheet 10 with the stripper 6 and the die 2. In this step, the metal sheet 10 is firmly fixed, because the protruding part 2*b* formed on the inner circumferential edge of the upper surface of the die 2 tightly fits in with the metal sheet 10.

The metal sheet 10 is fixed by bringing down the stripper 6 onto the metal sheet 10. When the stripper 6 comes down onto the metal sheet 10, the stripper 6 comes in close contact with the metal sheet 10 without leaving any gap therebetween. In the meantime, the gap between the stripper 6 and the punch plate 5 becomes larger.

<Burring Step>

As shown in FIG. 3C, the burring step is for burring the metal sheet 10. As the punch plate 5 is brought down, the burring punch 4 is pressed down into the burring hole 2*a* of the die 2, to which the metal sheet 10 has been fixed in the fixing step. The metal sheet 10 is hence burring machined. The burring punch 4 has the tapered tip, which is configured to fit into the pilot hole 10*h* formed on the metal sheet 10, when the burring punch 4 is brought down. When the burring punch 4 is brought down further into the burring hole 2*a*, a circumferential edge of the pilot hole 10*h* is pressed to be bent along a circumferential wall of the burring hole 2*a*. Additionally, the width of the clearance S between the burring hole 2*a* and the burring punch 4 is made not larger than the thickness t of the metal sheet 10. As a result, the boss 11, which is formed from the metal sheet 10, is subjected to ironing and burring by the burring hole 2*a* and the burring punch 4.

The pressed product manufactured in the burring method is formed such that a thickness of the boss 11 is in a range between 70% and 115% of the thickness t of the metal sheet 10, before the metal sheet 10 goes through the burring process. The boss 11 is formed to have the above-mentioned thickness, because the boss 11 ironed by the die 2 and the burring punch 4 of the press 60% and 115% of the metal sheet 10 slightly expands, after the metal sheet 10 is removed from the press die 1. The thickness of the boss 11 is not limited, as long as it is within the above-mentioned range. However, the thickness of the boss 11 is preferably in a range between 75% and 100%, and more preferably, in a range between 86% and 97% (see FIG. 2A and FIG. 2B).

The pressed product 15 has an angle $\phi$ between the boss 11 and the planar part 12 in a range between 85 degrees and 95 degrees. The pressed product 15 has the surrounding part 12' whose flatness is not more than 9% with respect to a distance "x" between the boss 11 and the edge wall 13 of the pressed product 15 (see FIG. 2A and FIG. 2B). That is, the pressed product 15 is configured such that the surrounding part 12' has a height of a warpage or an irregularity of not more than "a distance x ×0.09 mm".

In the pressed die 1, the burring method using the pressed die 1, and the method of manufacturing the pressed product 15 according to the embodiment, a warpage generated on the planar part 12 surrounding the boss 11 of the pressed product 15 can be reduced as described above. Therefore, the pressed die 1, the burring method using the pressed die 1, and the method of manufacturing the pressed product 15 can be applied to a burring of precision components such as a shutter for a recording disk cartridge. The shutter cannot fulfill its required function, if its planar part surrounding a boss has a warpage. Such a warpage obstructs an opening/shuttering/moving of the shutter.

The press die 1 is configured to have the width of the clearance S between the die 2 and the burring punch 4 substantially the same as or slightly smaller than the thickness t of the metal sheet 10. Hence, the thickness of the boss 11 after the burring is formed to be uniform.

The press die 1 has the protruding part 2*b* on the inner circumferential edge of the upper surface of the die 2. The protruding part 2*b* firmly fixes the metal sheet 10. Even when the burring punch 4 presses the metal sheet 10, the metal sheet 10 will not move. Therefore, the metal sheet 10 will not flow into the burring hole 2*a*, even when the burring punch 4 burring machines the metal sheet 10. The height of the boss 11 is thus formed to be uniform.

The tip of the burring punch 4 is tapered off, so that the nearer to the tip, the smaller the diameter of the tip of the burring punch 4. This means that the boss 11 is gradually formed, while the burring punch 4 is pressing and extending the pilot hole 10*h* little by little during the burring. Therefore the boss 11 can be formed in high quality.

The present invention has been described above with reference to the exemplary embodiment. However, the present invention is not limited to the embodiment, and various design changes are possible according to the necessity within a range not departing from the spirit and scope of the present invention.

For example, the thickness of the metal sheet is made to be 0.5 mm or less in the embodiment. However, the thickness of a workpiece which can be machined using the press die and the burring method according to the present invention is not limited to this, and may be set according to the necessity.

It is to be understood that any workpiece material may be used in the present invention without limitation.

The press die according to the present invention may be used as a single unit, and may be used as one of progressive dies.

In the embodiment, the protruding part is formed on the die. However, the protruding part may be formed on a portion of the stripper which comes in contact with the metal sheet. Protruding parts may be formed both on the die and on the stripper. No protruding part may be formed on the die or on the stripper.

The embodiment assumes that the pressed product is a component for a cartridge for accommodating a magnetic medium, more specifically, a shutter member for the cartridge. However, a purpose of use, a shape, or the like of the pressed product, which is formed using the press die and the burring method according to the present invention, is not limited.

EXAMPLE

Next is described a result of a proving test in improving a quality of the pressed product manufactured with the press die and the burring method according to the present invention.

In the proving test, workpiece materials were subjected to the burring with different widths of the clearances S between the die 2 and the burring punch 4. Warpages on each planar part of the workpieces were measured to prove an effect of the burring method using the press die 1 according to the present invention, in improving the quality of the pressed product (in reducing warpages on the planar part).

Figure 4A:
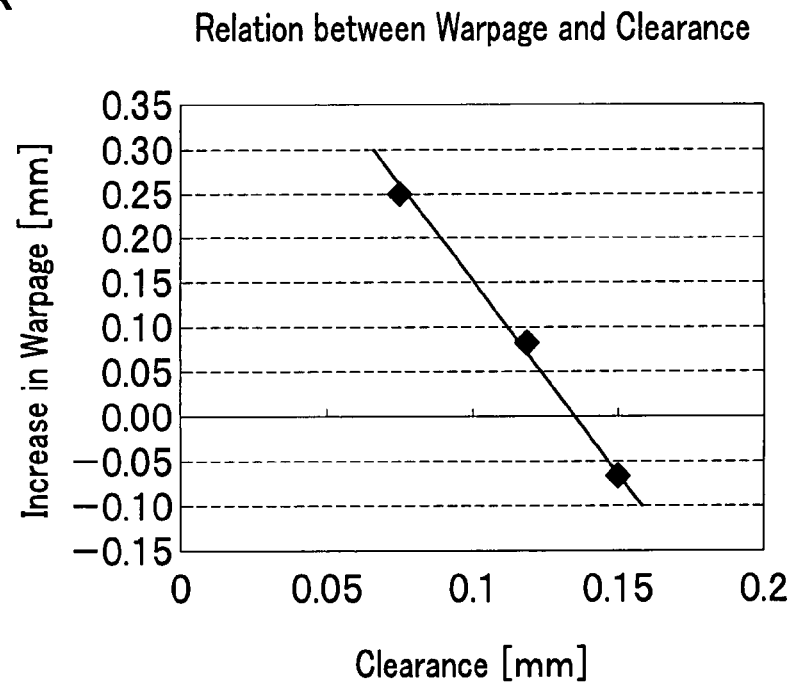
FIG. 4A is a graph showing a relation between a warpage on a pressed product and a clearance formed between a burring hole and a burring punch according to the embodiment.

In the proving test, the metal sheets 10 (stainless steel SUS304-SP) each having a thickness of 0.15 mm were used as shown in FIG. 4A. The width of the clearance S between the die 2 and the burring punch 4 were set at 50% (0.075 mm), 80% (0.12 mm), and 100% (0.15 mm) of the thickness of each metal sheet 10. Increases in warpages on the planar part 12 (see FIG. 4B) after the burring were measured for the respective metal sheets 10.

Figure 4B:
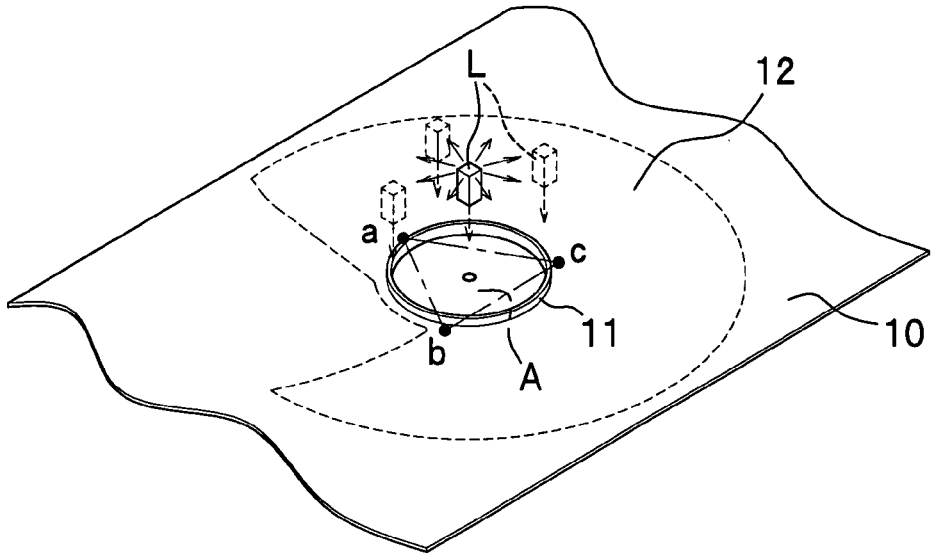
FIG. 4B is a schematic view illustrating a measurement method of the warpage.
Figure 4C:
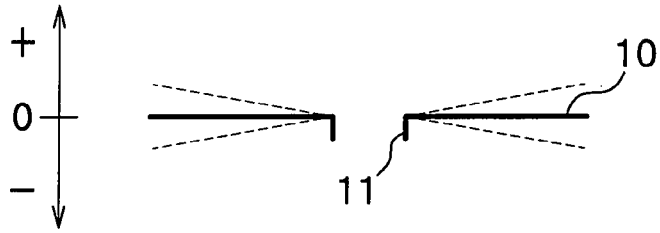
FIG. 4C is an explanatory view showing directions which the warpage faces.
Figure 5:
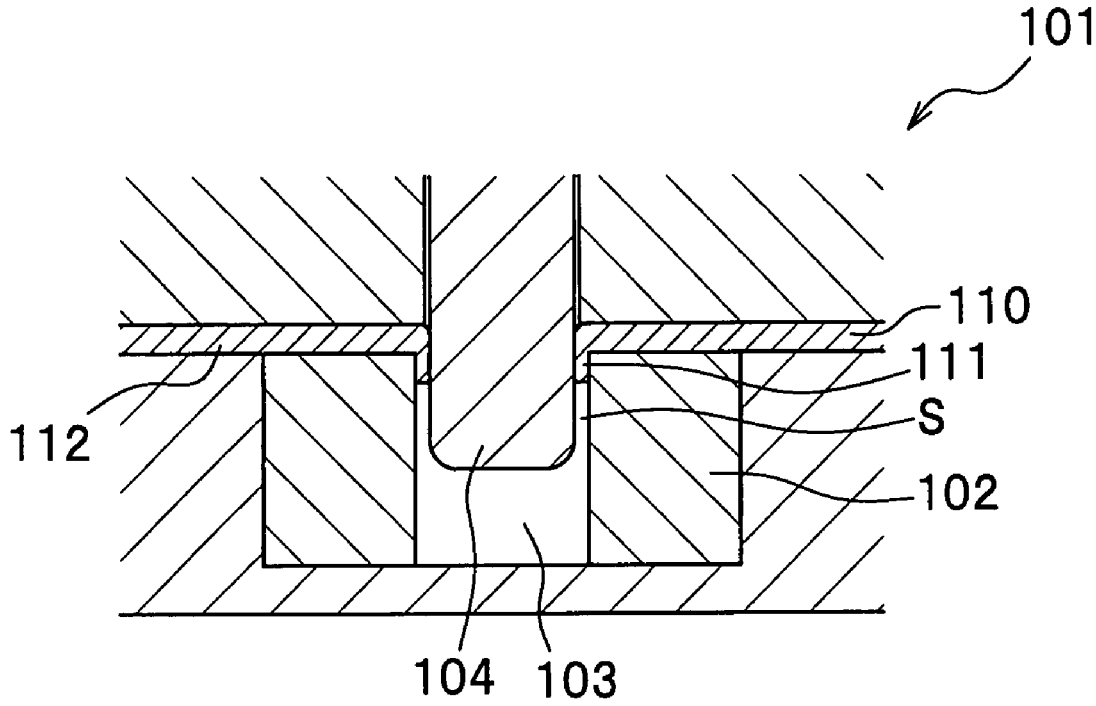
FIG. 5 is a cross sectional view showing a conventional press die.

The warpages (flatness) on the planar part 12 were measured as follows. As shown in FIG. 4B, a laser displacement meter L measured coordinates of three points, a, b, c, at a base of the boss 11, thus forming a virtual plane A. Subsequently, while the laser displacement meter L was moved in longitudinal, transverse and diagonal directions, the laser displacement meter L measured displacement magnitudes on the planar part 12. The displacement magnitudes represented warpages (irregularities) on the planar part 12 with respect to the virtual plane A. In FIG. 4C, a plus sign "+" indicates that a warpage direction is opposite to a direction in which the boss 11 is protruded. And, a minus sign "−" indicates that the warpage direction is the same as the protruding direction of the boss 11.

As shown in FIG. 4A, when the width of the clearance S was set at 50% (0.075 mm) of the thickness of the metal sheet 10, which is according to a conventional burring method, the warpage increased by about +0.25 mm. Meanwhile, when set at 80% (0.12 mm), the warpage increased by about +0.08 mm. When set at 100% (0.15 mm), the warpage increased by about −0.06 mm. The result showed that each warpage in the latter two cases was smaller than that in the former.

As can be seen in FIG. 4A, it is preferable that the width of the clearance S is in a range between 60% and 115% (0.09 mm to 0.17 mm) of the thickness t of the workpiece. Within the range, the warpage increased by slightly larger the thickness of the thickness t of the workpiece (0.15 mm) or less. This means that the warpage is greatly reduced, as compared to that generated when the width of the clearance S is 50% of the thickness t of the workpiece. It is more preferable that the width of the clearance S is in a range between 65% and 100% (0.1 mm to 0.15 mm). Within the range, the warpage increased by about the same thickness as the thickness t (0.15 mm) of the workpiece or less. It is further preferable that the width of the clearance S is in a range between 75% and 95% (0.11 mm to 0.14 mm). Within the range, the warpage increased by about 50% (0.075 mm) of the thickness t of the workpiece or less.

The result described above proved that, when the width of the clearance S was in the range between 60% and 115%, preferably between 65% and 100%, and more preferably between 75% and 95%, of the thickness t of the workpiece, the warpage on the planar part of the pressed product after burring was reduced.

Further, as the metal sheet 10, plates each made of aluminum (Al) and another type of stainless steel SUS304-CSP were subjected to the same proving test. The result was about the same as that obtained when the plates made of the stainless steel SUS304-SP were used.

The invention claimed is:

1. A press die for forming a boss on a workpiece comprising:

a die with a burring hole formed therein; and a burring punch having a shape adapted to be inserted into the burring hole, wherein a clearance which is formed between the burring hole and the burring punch when the burring punch is inserted into the burring hole, is in a range not less than 60% and not more than 115% of a thickness of the workpiece before the workpiece goes through a burring process, and wherein a protruding part formed on an inner circumferential edge of an upper surface of the die, and surrounding the burring hole has a width in a range between 50% and 400% of the thickness of the workpiece; and has a height in a range between 5% and 20% of the thickness of the workpiece.

2. A burring method for forming a boss on a workpiece comprising the steps of:

fixing the workpiece on a die with a burring hole formed therein; and pressing a burring punch from a direction opposite to a contact surface of the workpiece on which the workpiece is in contact with the die, through the workpiece into the burring hole of the die, wherein a width of a clearance, which is formed between the burring hole and the burring punch when the burring punch is inserted into the burring hole, is in a range not less than 60% and not more than 115% of a thickness of the workpiece, before the workpiece goes through a burring process, and wherein a protruding part formed on an inner circumferential edge of an upper surface of the die, and surrounding the burring hole has a width in a range between 50% and 400% of the thickness of the workpiece; and has a height in a range between 5% and 20% of the thickness of the workpiece.

3. A method of manufacturing a pressed product having a planar part and at least one boss formed on the planar part, and obtained by burring a workpiece using a press die including: a die with a burring hole formed therein; and a burring punch having a shape adapted to be inserted into the burring hole, the method comprising the steps of:

fixing the workpiece on the die; and pressing the burring punch from a direction opposite to a contact surface of the workpiece on which the workpiece is in contact with the die, through the workpiece into the burring hole of the die, wherein a width of a clearance, which is formed between the burring hole and the burring punch when the burring punch is inserted into the burring hole, is in a range not less than 60% and not more than 115% of a thickness of the workpiece, before the workpiece goes through a burring process, and wherein a protruding part formed on an inner circumferential edge of an upper surface of the die, and surrounding the burring hole has a width in a range between 50% and 400% of the thickness of the workpiece; and has a height in a range between 5% and 20% of the thickness of the workpiece.

4. A pressed product having a planar part and at least one boss formed on the planar part, and obtained by burring a workpiece using a press die including: a die with a burring hole formed therein; and a burring punch having a shape adapted to be inserted into the burring hole, wherein a thickness of the boss is in a range not less than 70% and not more than 115% before the workpiece goes through a burring process, and wherein a protruding part formed on an inner circumferential edge of an upper surface of the die, and surrounding the burring hole has a width in a range between 50% and 400% of the thickness of the workpiece; and has a height in a range between 5% and 20% of the thickness of the workpiece.

5. The pressed product according to claim 4, wherein a thickness of the workpiece is 0.5 mm or less before the workpiece goes through a burring process.

6. The press die according to claim 1, wherein the clearance between the burring hole and the burring punch is in a range not less than 65% and not more than 100% of the thickness of the workpiece before the workpiece goes through the burring process.

7. The burring method according to claim 2, wherein the clearance between the burring hole and the burring punch is in a range not less than 65% and not more than 100% of the thickness of the workpiece before the workpiece goes through the burring process.

8. The method of manufacturing a pressed product according to claim 3, wherein the clearance between the burring hole and the burring punch is in a range not less than 65% and not more than 100% of the thickness of the workpiece before the workpiece goes through the burring process.

9. The press die according to claim 1, wherein the clearance between the burring hole and the burring punch is in a range not less than 75% and not more than 95% of the thickness of the workpiece before the workpiece goes through the burring process.

10. The burring method according to claim 2, wherein the clearance between the burring hole and the burring punch is in a range not less than 75% and not more than 95% of the thickness of the workpiece before the workpiece goes through the burring process.

11. The method of manufacturing a pressed product according to claim 3, wherein the clearance between the burring hole and the burring punch is in a range not less than 75% and not more than 95% of the thickness of the workpiece before the workpiece goes through the burring process.

12. The pressed product according to claim 4, wherein the thickness of the workpiece is 0.3 mm or less before the workpiece goes through the burring process.

13. The pressed product according to claim 4, wherein the thickness of the workpiece is 0.25 mm or less before the workpiece goes through the burring process.

14. The pressed product according to claim 4, wherein the thickness of the boss is preferably in a range between 75% and 100% before the workpiece goes through the burring process.

15. The pressed product according to claim 4, wherein the thickness of the boss is in a range between 86% and 97% before the workpiece goes through the burring process.

16. The pressed product according to claim 4, wherein the boss is formed at an angle in a range not less than 85 degrees and not more than 95 degrees with respect to the planar part.

17. The pressed product according to claim 5, wherein the boss is formed at an angle in a range not less than 85 degrees and not more than 95 degrees with respect to the planar part.

18. The pressed product according to claim 4, wherein a surrounding part has a flatness of not more than 9% with respect to a distance between the boss and an outer circumference of the surrounding part.

19. The pressed product according to claim 5, wherein a surrounding part has a flatness of not more than 9% with respect to a distance between the boss and an outer circumference of the surrounding part.

20. The press die according to claim 1, wherein a protruding part formed on an inner circumferential edge of an upper surface of the die, and surrounding the burring hole has a width in a range between 150% and 300% of the thickness of the workpiece; and has a height in a range between 5% and 20% of the thickness of the workpiece.

21. The burring method according to claim 2, wherein a protruding part formed on an inner circumferential edge of an upper surface of the die, and surrounding the burring hole has a width in a range between 150% and 300% of the thickness of the workpiece; and has a height in a range between 5% and 20% of the thickness of the workpiece.

22. The method of manufacturing a pressed product according to claim 3, wherein a protruding part formed on an inner circumferential edge of an upper surface of the die, and surrounding the burring hole has a width in a range between 150% and 300% of the thickness of the workpiece; and has a height in a range between 5% and 20% of the thickness of the workpiece.

23. The pressed product according to claim 4, wherein a protruding part formed on an inner circumferential edge of an upper surface of the die, and surrounding the burring hole has a width in a range between 150% and 300% of the thickness of the workpiece; and has a height in a range between 5% and 20% of the thickness of the workpiece.

24. The press die according to claim 1, wherein the workpiece is made of any one of aluminum, stainless steel SUS304-SP, and stainless steel SUS304-CSP.

25. The burring method according to claim 2, wherein the workpiece is made of any one of aluminum, stainless steel SUS304-SP, and stainless steel SUS304-CSP.

26. The method of manufacturing a pressed product according to claim 3, wherein the workpiece is made of any one of aluminum, stainless steel SUS304-SP, and stainless steel SUS304-CSP.

27. The pressed product according to claim 4, wherein the workpiece is made of any one of aluminum, stainless steel SUS304-SP, and stainless steel SUS304-CSP.

28. The pressed product according to claim 5, wherein the workpiece is made of any one of aluminum, stainless steel SUS304-SP, and stainless steel SUS304-CSP.

29. The pressed product according to claim 4, wherein the pressed product is a component of a cartridge for accommodating a magnetic medium.

30. The pressed product according to claim 5, wherein the pressed product is a component of a cartridge for accommodating a magnetic medium.

* * * * *